US008464370B2

(12) United States Patent
Beck et al.

(10) Patent No.: US 8,464,370 B2
(45) Date of Patent: Jun. 18, 2013

(54) CONVERTIBLE FURNITURE ITEM

(75) Inventors: Daniel J. Beck, Huntington Beach, CA (US); Charles Steers, Carthage, MO (US)

(73) Assignee: L & P Property Management Company, South Gate, CA (US)

( * ) Notice: Subject to any disclaimer, the term of this patent is extended or adjusted under 35 U.S.C. 154(b) by 331 days.

(21) Appl. No.: 12/779,949

(22) Filed: May 13, 2010

(65) Prior Publication Data

US 2011/0277233 A1 Nov. 17, 2011

(51) Int. Cl.
*A47C 17/04* (2006.01)

(52) U.S. Cl.
USPC ..... 5/47; 5/16; 5/17; 5/18.1; 5/57.1

(58) Field of Classification Search
USPC ..... 5/13, 16, 17, 18.1, 47, 57.1; 403/150–154
See application file for complete search history.

(56) References Cited

U.S. PATENT DOCUMENTS 2,730,727 A 1/1956 Schneller
3,877,087 A * 4/1975 Harty ..... 5/13
4,217,669 A 8/1980 Fefferman
4,365,369 A * 12/1982 Plume ..... 5/38
6,487,800 B1 12/2002 Evans et al.
7,945,974 B2 * 5/2011 Cabrera et al. ..... 5/47
2008/0066227 A1 3/2008 James et al.
2008/0092290 A1 4/2008 Cabrera et al.

OTHER PUBLICATIONS

International Search Report and Written Opinion for PCT/US 11/33781, mailed Apr. 25, 2011.

* cited by examiner

*Primary Examiner* — Robert G Santos
*Assistant Examiner* — Nicholas Polito
(74) *Attorney, Agent, or Firm* — Shook Hardy & Bacon LLP

(57) ABSTRACT

The present invention is directed to a furniture item having user-support frames that are convertible between a seat configuration and a bed configuration. In one embodiment, user-support frames include a head-support frame anchored by a link assembly to a furniture-item base and a back-support frame pivotably coupled to the head-support frame. The link assembly facilitates both pivoting and lateral shifting of the head-support frame relative to the furniture-item base. In the bed configuration, a cam and cam follower are disposed under the user-support frames, such that when the user-support frames laterally shift, the cam contacts the cam follower, thereby upwardly moving a junction at which user-support frames are hinged to one another.

12 Claims, 8 Drawing Sheets

CONVERTIBLE FURNITURE ITEM

BACKGROUND

The present invention relates to a furniture item that is convertible between a seat configuration and a bed configuration. Examples of such furniture items include a sofa-bed and a futon.

Often, convertible furniture items include springs that do not provide a desired level of user support. Moreover, some convertible furniture items include a design that is complex and/or unstable. For example, a convertible furniture item including a frame that is folded in its entirety into a base portion of the furniture item might have numerous moving parts. Such convertible furniture items might be complex to manufacture, heavy, and not user friendly.

Accordingly, a convertible furniture item that provides a better support structure and that is less complex to operate and manufacture would be beneficial.

BRIEF SUMMARY

Embodiments of the invention are defined by the claims below, not this summary. A high-level overview of various aspects of the invention are provided here for that reason, to provide an overview of the disclosure, and to introduce a selection of concepts that are further described below in the detailed-description section. This summary is not intended to identify key features or essential features of the claimed subject matter, nor is it intended to be used as an aid in isolation to determine the scope of the claimed subject matter.

The present invention is directed to a furniture item having user-support frames that are convertible between a seat configuration and a bed configuration. In one embodiment, user-support frames include a first support frame anchored to a furniture-item base and a middle support frame pivotably coupled to the first support frame. In a further embodiment, a link assembly couples the first support frame to the furniture-item base. A pin couples the link assembly to the furniture-item base, and a pivot mechanism couples the link assembly to the first support frame. As such, the combination of the link assembly, the first pin, and the pivot mechanism facilitates both pivoting and lateral shifting of the first support frame relative to the furniture-item base.

In a further embodiment, a cam block and a cam-follower block are disposed under the user-support frames when the user-support frames are in the bed configuration. When the user-support frames laterally shift, the cam block contacts the cam-follower block, thereby upwardly moving a junction at which user-support frames are hinged to one another.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The subject matter of embodiments of the present invention is described with specificity herein to meet statutory requirements. But the description itself is not intended to necessarily limit the scope of claims. Rather, the claimed subject matter might be embodied in other ways to include different steps or combinations of steps similar to the ones described in this document, in conjunction with other present or future technologies.

Figure 2:
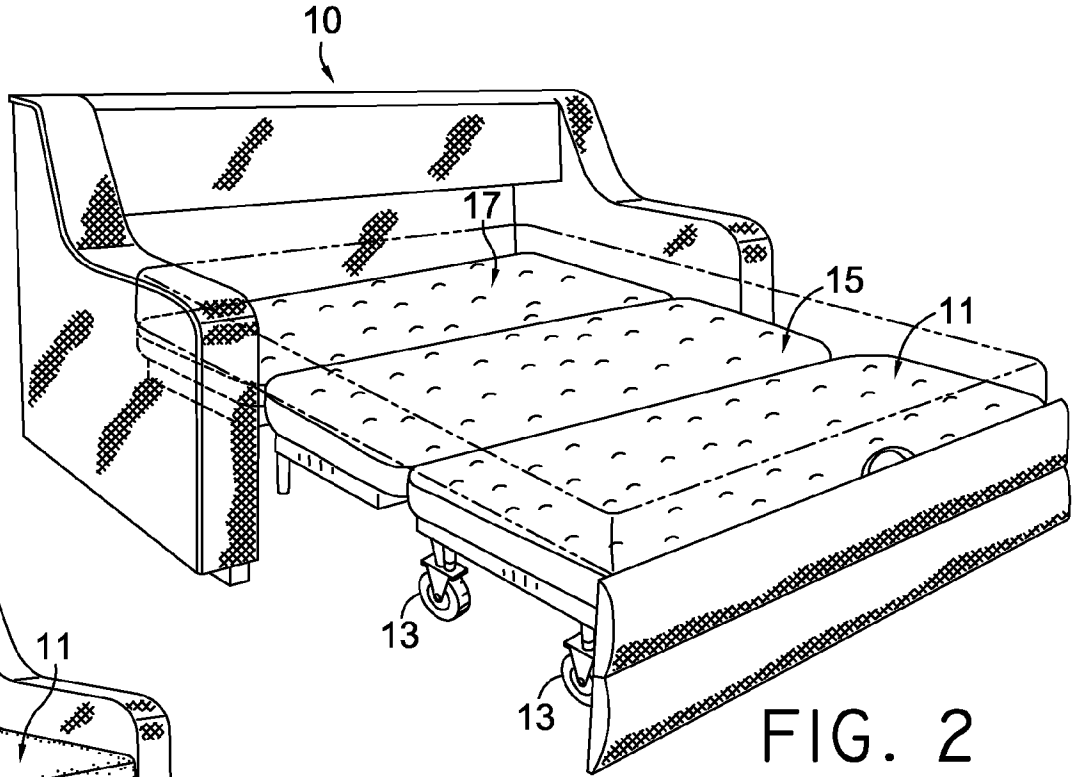
FIG. 2 is perspective view of a convertible furniture item is a bed configuration.
Figure 1:
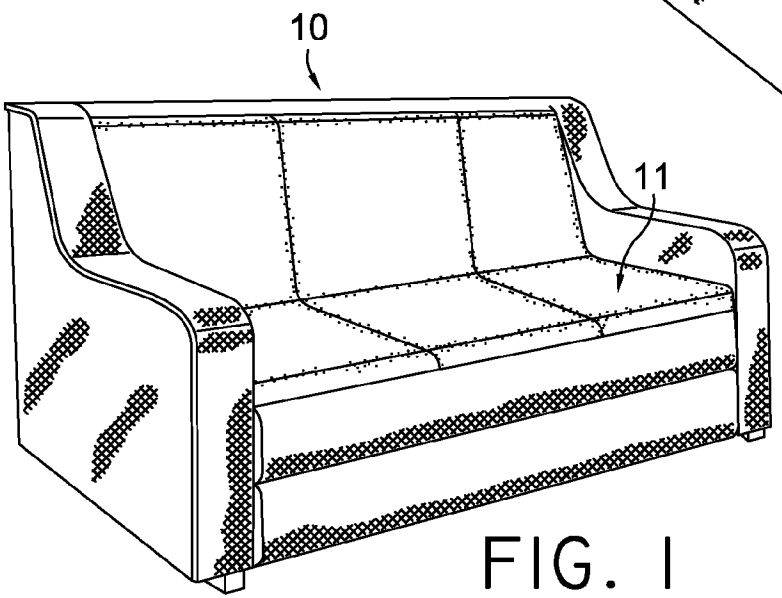
FIG. 1 is a perspective view of a convertible furniture item in a seat configuration.

Referring to FIGS. 1 and 2, the present invention relates to a furniture item 10. In a folded (i.e., retracted) position depicted in FIG. 1, the furniture item 10 might be used for sitting, and this configuration might be referred to herein as a "seat configuration." In an unfolded (i.e., extended) position depicted in FIG. 2, the furniture item 10 might be used as a bed on which to lie down, and this configuration might be referred to herein as a "bed configuration." Although the labels "seat configuration" and "bed configuration" suggest a specific use of furniture item 10, such labels are only used to distinguish between various configurations of furniture item and should not be interpreted to limit the use of furniture item 10 when in a particular configuration. For example, the seat configuration could be used to lie down and the bed configuration could be used to sit.

Generally, furniture item 10 is convertible from the seat configuration of FIG. 1 to the bed configuration of FIG. 2 by sliding or pulling a front portion 11 from the retracted position of FIG. 1, into an extended position depicted by FIG. 2. For example, front portion 11 might be slid or rolled using wheels 13. As front portion 11 is slid outward from the retracted position to the extended position, portions 15 and 17 (portion 17 is not visible in FIG. 1) are extended from a relatively vertical position to a relatively horizontal position. Further, the furniture item 10 is convertible from the bed configuration of FIG. 2 to the seat configuration of FIG. 1 by sliding or pushing front portion 11 from the extended position of FIG. 2, into a retracted position depicted by FIG. 1. As front portion 11 is slid inward from the extended position to the retracted position, portions 15 and 17 are folded from a relatively horizontal position to a relatively vertical position. FIG. 2 depicts an embodiment in which a bed cushion (e.g., foam, mattress, air mattress, etc.) has been positioned on top of portions 15 and 17.

Figure 3:
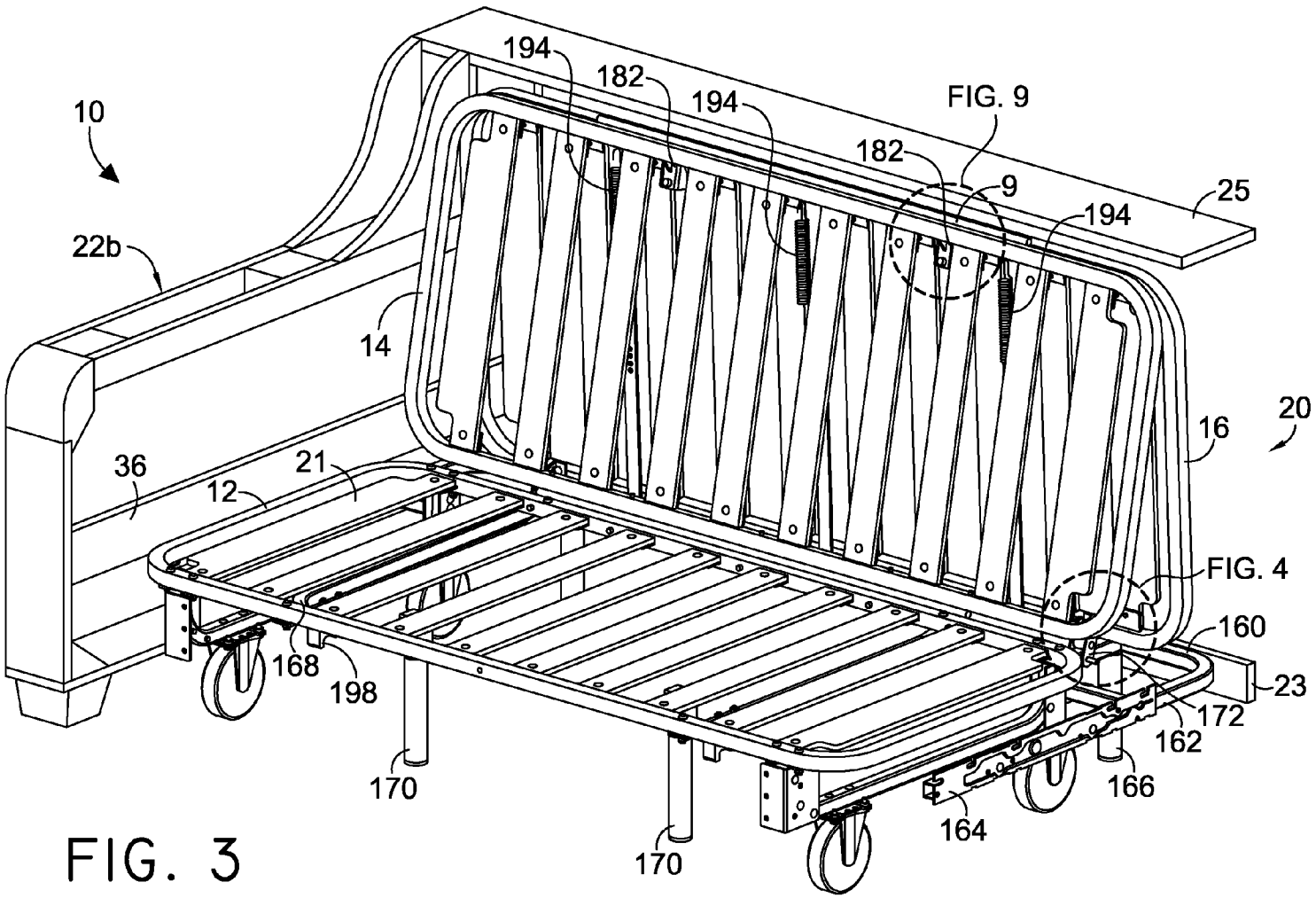
FIG. 3 is a perspective view of a frame of a convertible furniture item in a seat configuration.

Referring now to FIG. 3, a user-support frame 20 is depicted that serves as an underlying structure of furniture item 10. That is, while FIGS. 1 and 2 depict an upholstered furniture item, FIG. 3 depicts a frame that functions to support the upholstered furniture item. More specifically, FIG. 3 depicts user-support frame 20 in a seat configuration.

Furniture item 10 might include various structure components. For example, FIG. 3 depicts a rear base board 23 and a hood member 25. Rear base board 23 might generally define the rear of furniture item 10 and function as a base onto which other components attach. Moreover, the rear base board 23 and the arm rests 22*a* and 22*b* might cover any mechanisms that are preferably hidden from view. Hood member 25 might extend over and cover a junction 19 between the panels when the furniture item 10 is in the seat configuration. In an embodiment of the present invention, furniture item 10 includes armrests 22*a* and 22*b*, each of which includes a respective internal support structure 36. Internal support structure 36 might be fabricated from wood, metal, or any other suitable material used to construct furniture-support structures.

Figure 6:
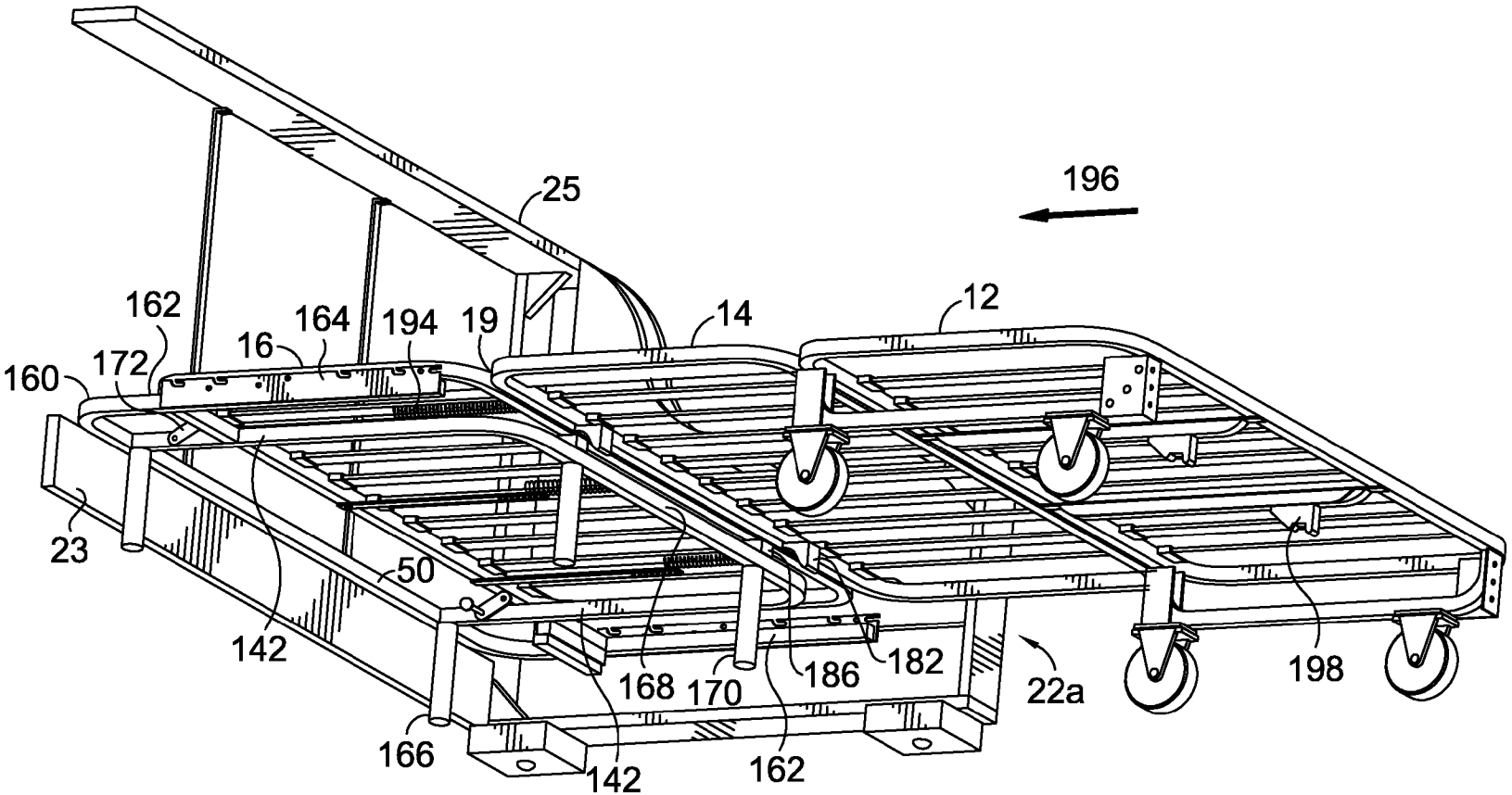
FIG. 6 is a bottom perspective view of a frame of a furniture item in a bed configuration.

With continued reference to FIG. 3, and also to FIG. 6, a user-support frame is a combination of various components, such as frames 160, 168, 16, 14, and 12. More specifically, frame 160 is substantially u-shaped and is preferably made from bent tube steel, but other materials could also be suitably used. As best seen in FIG. 6, frame 160 has forwardly extending arms 162. An attachment bracket 164 is coupled to the outward side of each arm 162. Brackets 164 are used to couple the frame 160 to the armrests, such as to an armrest internal frame 36. In an alternative embodiment (not shown) brackets might be arranged on other positions of frame 160, such as along a distal end 50 of frame 160, and used to couple frame 160 to baseboard 23. A pair of rearward supports 166 is attached to the frame 160 and extends downwardly from the frame 160 to support the frame against a ground surface. A forward u-shaped frame 168 is attached to the frame 160, such that the arms 142 (seen in FIG. 6) of the frame 168 extend opposite the arms 162. Frames 160 and 168 thus form a generally rectangular frame when coupled together. A pair of forward supports 170 is attached to frame 168 and extends downwardly from frame 168 to support the frame against a ground surface. The frames 160 and 168, along with the supports 166 and 170, provide support to other portions of furniture item 10, as is more-fully described below.

In an embodiment of the present invention, brackets 164 allow the framework of furniture item 10 to be placed within a furniture-item shell, such that the framework can easily be secured to the shell using only the brackets 164. That is, in an embodiment of the present invention, only the brackets 164 are used to secure user-support frame (including frames 160, 168, 16, 14, and 12), which converts from a seat configuration to a bed configuration, to the shell. When user-support frame 20 is secured within furniture item 10, frames 160 and 168 effectively function as furniture-item base. Such an embodiment of the present invention is in contrast to other types of furniture items, which require mounting brackets (such as brackets 164), in addition to other hardware that couples other portions of user-support frame 20 (such as frame 16) to the furniture shell.

Figure 5:
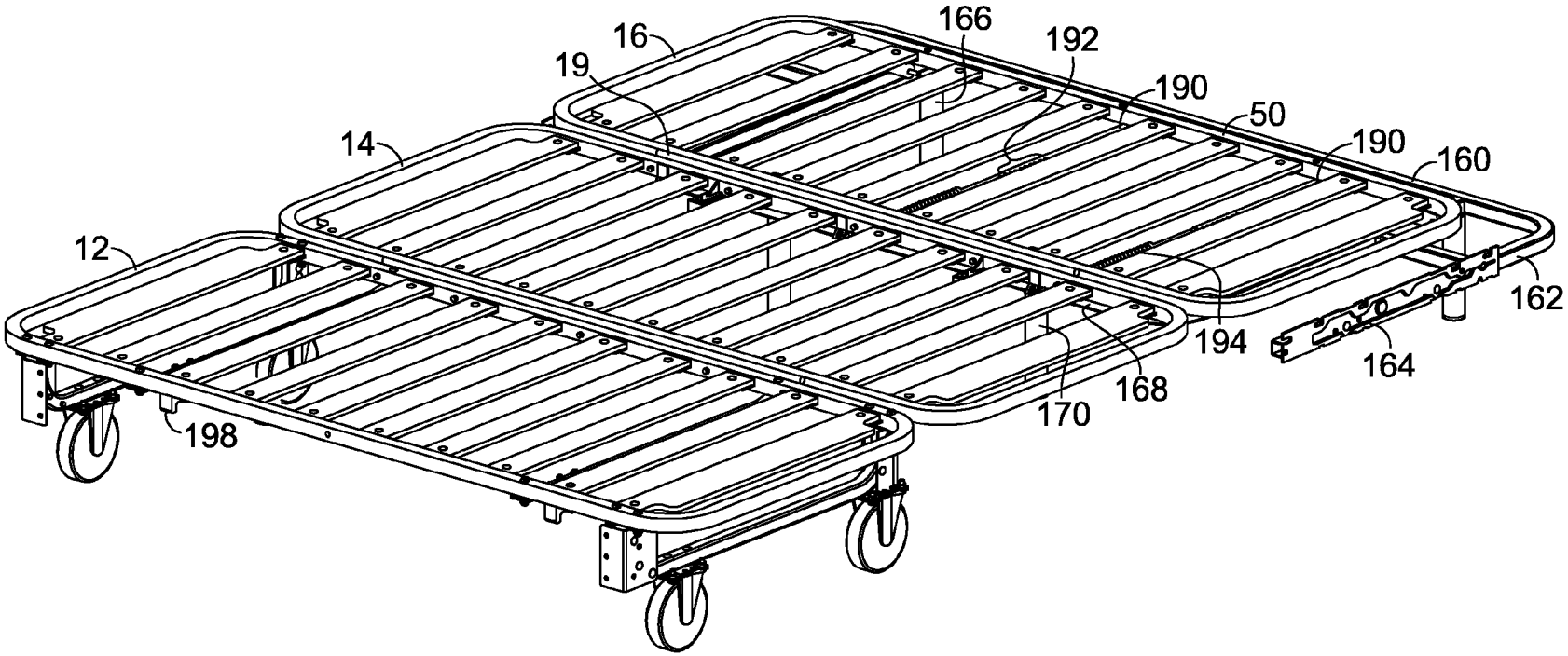
FIG. 5 is a perspective view of a frame of a furniture item in a bed configuration.

In an embodiment of the present invention a combination of frames 16, 14, and 12 attaches to frame 160 and/or frame 168 and is convertible between a retracted configuration (depicted in FIG. 3) and an extended configuration (depicted in FIG. 5). More specifically, a first support member 16 is hinged to a second support member 14, which is hinged to a third support member 12, and the first support member 16 is coupled to frame 160 and/or frame 168, thereby attaching the combination thereto. Because second support member 14 is coupled between first support member 16 and third support member 12, second support member 14 might also be referred to herein as a "middle support member."

As can be seen in FIG. 3, in a seat configuration, third support member 12 is substantially parallel with a ground surface, and second support member 14 and first support member 16 are substantially angled with respect to a ground surface. More specifically, FIG. 3 depicts that second support member 14 is positioned at a slight recline, such as might be found in a seatback of a furniture item (e.g., sofa). Accordingly, in the seat configuration, third support member 12 is usable to support a buttocks and legs of a user sitting on furniture item 10, and second support member 14 is usable to support a back of the user. Furthermore, first support member 16 is retracted into a back portion of furniture item 10. As can be seen in FIG. 5, in a bed configuration, first support member 16, second support member 14, and third support member 12 are substantially coplanar. As such, in a bed configuration, first support member 16 is usable to support a head of a user lying on furniture item 10; second support member 14 is usable to support a mid-section of a user; and third support member is usable to support feet and lower legs of a user. Based on the respective functionalities of each of the support members, and for descriptive purposes herein, first support member 16 might also be referred to as "head-support member"; second support member 14 might be referred to as "back-support member"; and third support member 12 might be referred to as "leg-support member". Although labels "head-support member," "back-support member," and "leg-support member" suggest a specific functionality, such labels are only used to distinguish between various support members of furniture item 10 and should not be interpreted to limit the functionality of each support member.

In a further embodiment, a hard flat member (e.g., plywood or particle board) might be attached to each of support members 16, 14, and 12 to provide a surface upon which cushions might rest upon. Alternatively, a plurality of rigid boards (e.g., wood slats 21) might be attached to the support members, as depicted in FIGS. 3 and 5. The hard flat member and/or wood slats 21 provide support beneath a user when the user is lying or sitting on the furniture item 10.

Figure 4:
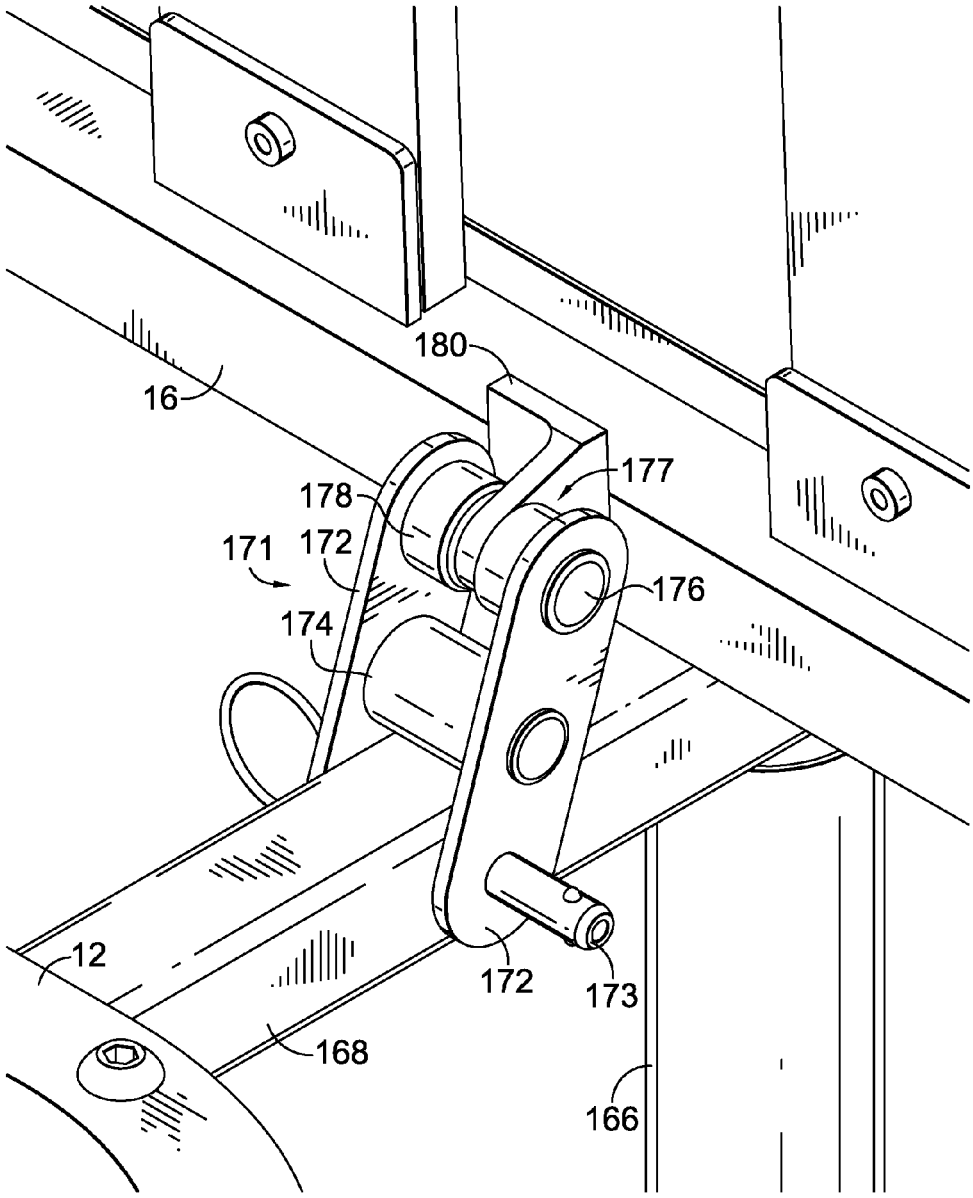
FIG. 4 is an enlarged view of an encircled region indicated in FIG. 3, from a slightly different angle to show a linkage between user-support frames.

Referring now to FIG. 4, which depicts an enlarged view of a circle depicted in FIG. 3, in an embodiment of the present invention, the head-support member 16 is coupled to frame 168 by a link assembly 171. More specifically, link assembly 171 includes a pair of links 172 that are positioned substantially parallel to one another and that are pivotally coupled to an arm 142 of frame 168 by a pin 173. A roller 174 is also pivotably coupled between the links 172. Roller 174 operates not only to space the links 172 apart, but also provides a rolling support as the linkage moves (i.e., pivots on pin 173). Tops of the links 172 are pivotably coupled to the first support member 16 (i.e., head-support member) by a pivot mechanism 177. In one embodiment, the pivot mechanism 177 includes a shaft 176, a pair of bushings 178, and an attachment bracket 180 coupled to first support member 16. Links 172, together with pin 173 and the pivot mechanism 177, enable the first support member 16 to pivot and move laterally with respect to frames 160 and 168. That is, pivoting of the link assembly 171 about pin 173 allows the first support member 16 to move laterally with respect to frame 168. In addition, pivoting of the first support member 16 and link assembly 171 about pivot mechanism 177 allows the first support member 16 to pivot with respect to frame 168. For example, first support member 16 might pivot and move laterally with respect to frames 160 and 168 when first support member 16 is converted between a seat configuration (FIG. 3) and a bed configuration (FIG. 5). In an embodiment of the present invention (seen in FIG. 6), furniture item 10 includes a respective links 172 coupled to each of arms 142 of frame 168.

Figure 9:
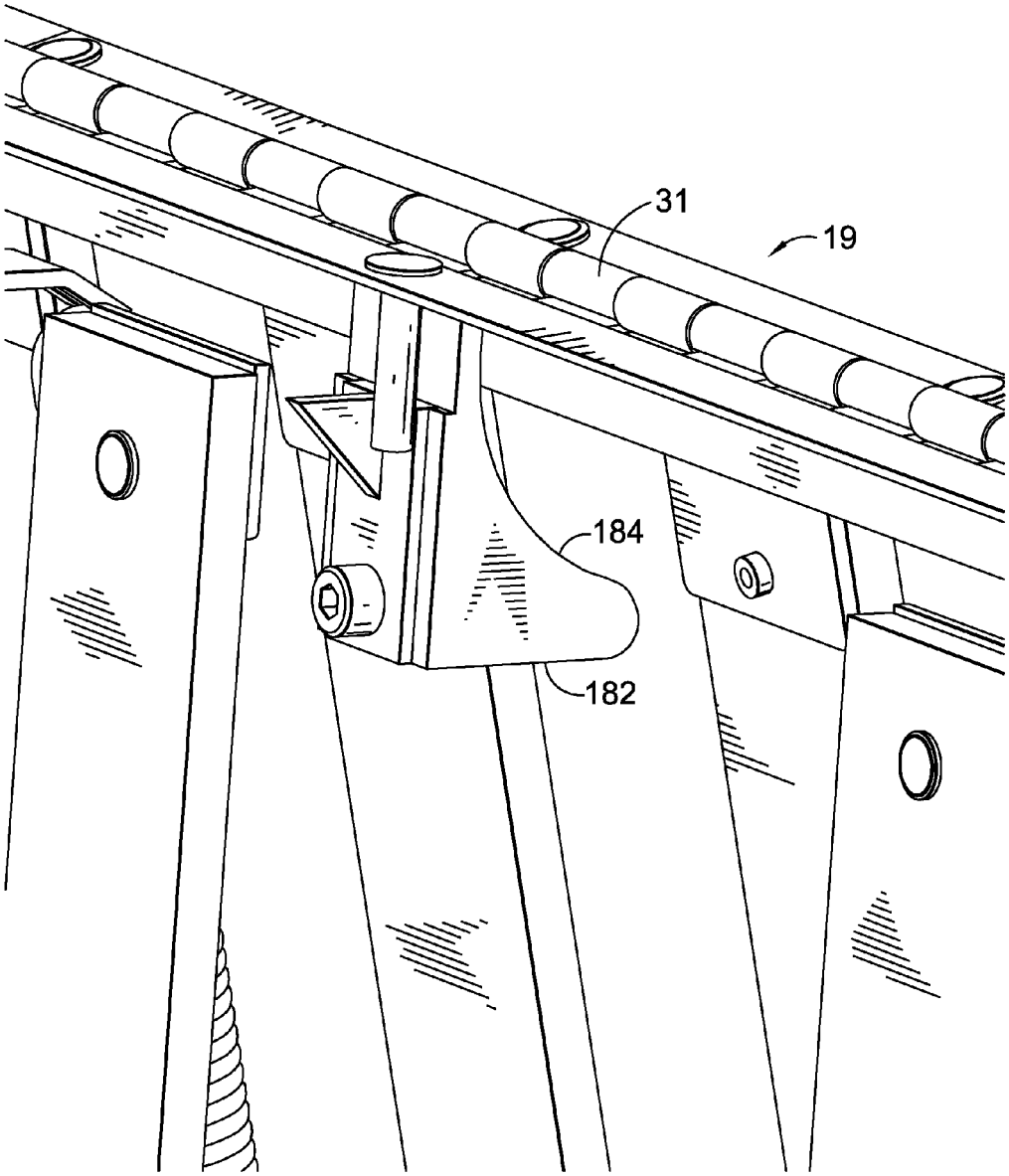
FIG. 9 is an enlarged view of the encircled region indicated in FIG. 3, from a slightly different angle to show the cam.

Referring briefly to FIGS. 5 and 6, head-support member 16 and back-support member 14 are in a bed configuration and are substantially coplanar. In one embodiment, head-support member 16 and back-support member 14 are hinged to one another at a junction 19, such as by a hinge positioned at the junction 19. An example of a hinge 31 at junction 19 is depicted in FIG. 9. Because head-support member 16 and back-support member 14 are hinged to one another at junction 19, when force is applied in an upward direction (e.g., opposite to a ground surface), the plane of members 14 and 16 is broken, thereby allowing head-support member 16 and back-support member 14 to be retracted into a seat configuration, as depicted in FIG. 3. FIG. 3 depicts junction 19 when both head-support member 16 and back-support member 14 are substantially upright in the seat configuration.

Figure 7:
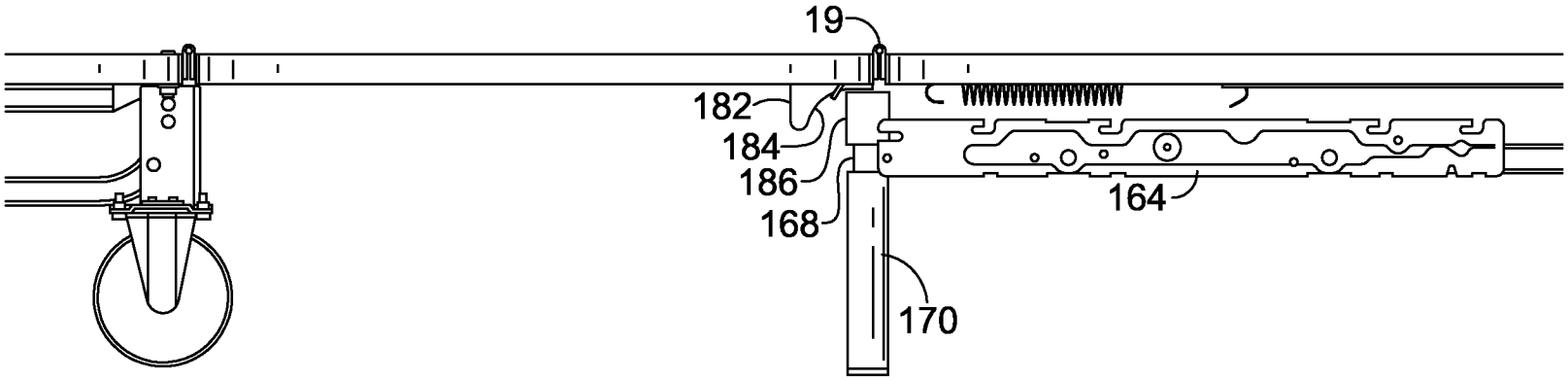
FIG. 7 is a side view of a frame of a furniture item.

Referring now to FIGS. 6 and 7, in an embodiment of the present invention, a pair of cam blocks 182 are coupled beneath back-support member 14, proximate to junction 19. For example, cams 182 might be coupled to an underneath side of back-support member 14 and close to junction 19 at which back-support member 14 is hinged to head-support member 16. In one embodiment, each cam 182 has an arcuate surface 184, which is oriented facing downwardly when back-support member 14 is in an extended position (bed configuration) and rearwardly when back-support member 14 is in the upright retracted position (seat configuration).

In a further embodiment, a respective cam-follower block 186 is aligned with each of cams 182. For example, cam-follower blocks 186 might be coupled to a top of frame 168 directly above the location of the forward supports 170. Each cam-follower block 186 is thus aligned with a corresponding cam 182 when back-support member 14 is in the extended position (bed configuration). In one embodiment, when back-support member 14 and head-support member 16 are in the extended position, cam-follower blocks 186 provide support for the junction 19. That is, in a bed configuration, at least a portion of members 14 and 16 are supported by cam-follower blocks 186.

Figure 8:
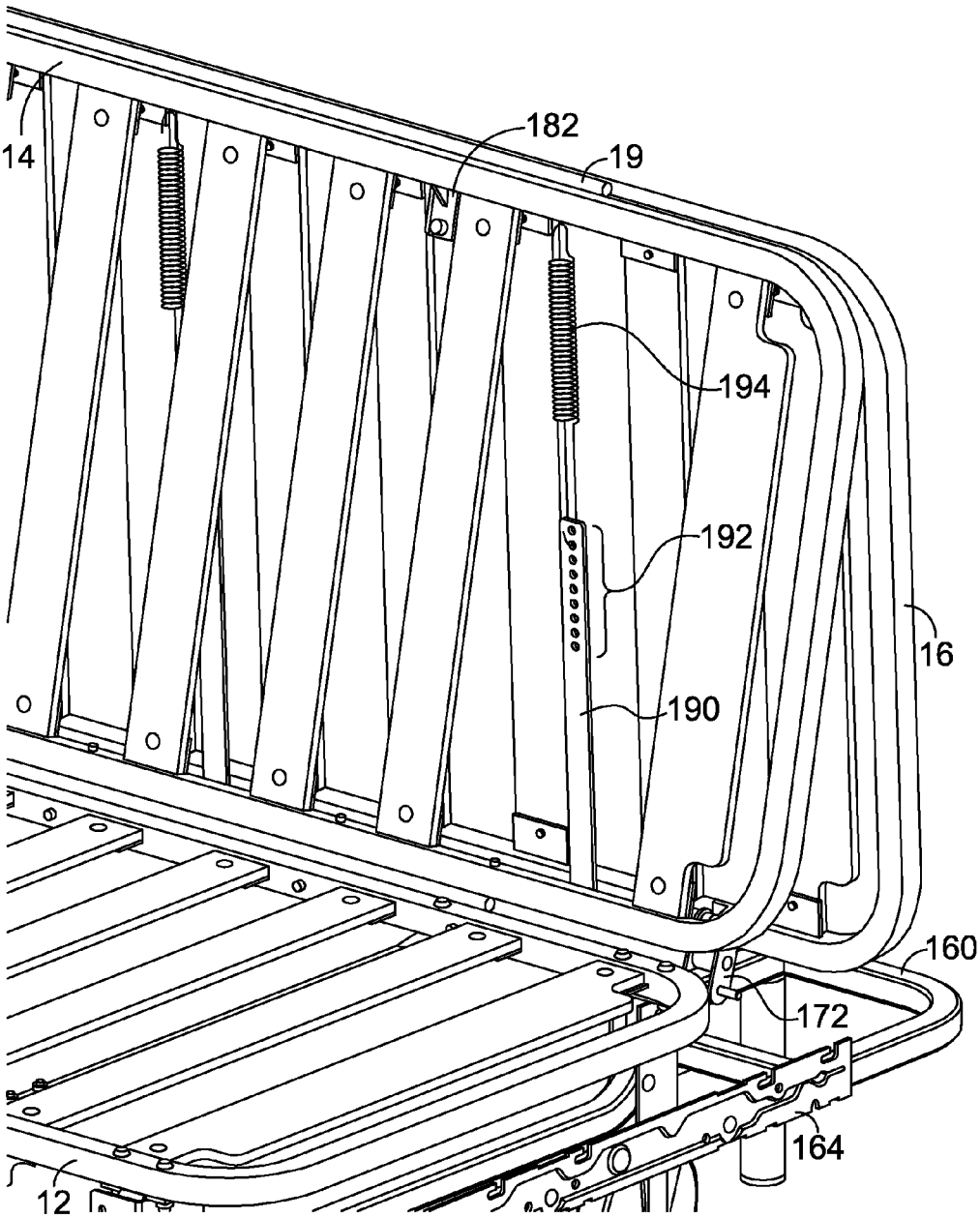
FIG. 8 is an enlarged, partial perspective view of portions of the frame of FIG. 3.

With reference to FIGS. 3 and 8, a series of spring brackets 190 are rigidly secured to the distal end 50 of the head-support member 16. As shown in the figures, three spring brackets 190 might be used; however, more, or fewer, spring brackets 190 could also be used. Each spring bracket 190 extends away from the distal end 50, parallel to the plane of the head-support member 16. A series of adjustment holes 192 are formed in each spring bracket 190. The holes 192 provide adjustment for a corresponding spring 194. One end of spring 194 is secured to the spring bracket 190 using one of the holes 192, and as seen in FIG. 8, the other end of spring 194 is secured to back-support member 14 near the junction 19. The springs 194 operate to bias furniture item 10 to the retracted position, and aid a user in moving furniture item 10 from the extended to the retracted position.

In operation, with furniture item 10 in the seat configuration, a user might move furniture item 10 to the bed configuration by pulling outwardly the leg-support member 12, which is hinged to back-support member 14. As leg-support member 12 is pulled outward, thereby also extending back-support member 14, head-support member 16 pivots about the pivot mechanism 177 and laterally shifts when link assembly 171 pivots on pin 173. For example, in the bed configuration, FIG. 6 depicts that the links 172 have pivoted about pin 173, allowing the head-support member 16 (as well as the back-support member 14 and leg-support member 12) to move laterally away from the distal end 50 of frame 160. Also in the extended position, the junction 19 rests upon blocks 186, with the cams 182 positioned slightly in front of the blocks 186.

In further operation, to move furniture item 10 from the bed configuration to the seat configuration, a user might apply a force in the direction of arrow 196. In response to the force, link assembly 171 allows support members 16, 14, and 12 to move laterally rearward towards the distal portion 50 of frame 160. This lateral movement allows each cam 182 to contact its corresponding block 186. That is, arcuate surface 184 contacts block 186, which exerts a force against surface 184, thereby causing junction 19 to buckle and move upwardly, assisting the user to fully retract furniture item 10. The springs 194 assist the user in moving the foot-support member 12 to a fully-retracted position. That is, in a bed configuration, springs 194 are stretched between brackets 190 and back-support member 14, thereby creating tension in the springs that biases the head-support member 12 and the back-support member 14 toward a retracted position. The adjustment holes 192 can be used to vary the amount of assistance provided to a user.

In a further embodiment of the present invention, a locking mechanism is included to secure furniture item 10 in the retracted position. For example, a locking block 198 might be provided on the underside of foot-support member 12. Locking block 198 is positioned such that a groove in the block 198 corresponds to the shape and location of the forward frame 168. In the retracted position, a portion of the frame 168 is positioned within this groove. As shown in FIG. 3, foot-support member 12 is not yet in the fully-retracted position, as frame 168 is not positioned within the groove of locking block 98. An angled face (seen in FIG. 6) of block 198 assists with pushing block 198 onto frame 168, such that frame 168 is positioned within the grove. To move furniture item 10 to the extended position (i.e., to pull foot-support member 12 from the locked position) a user might slightly lift the foot-support member 12 to clear frame 168 from the groove.

Described above is a furniture item that is convertible between a seat configuration and a bed configuration. The present invention includes various advantageous components, such as (but not limited to) link assembly 171, a combination of cam block 182 and cam-follower block 186, brackets 164, and locking block 198. For example, link assembly 171 provides an advantageous mechanism, which includes fewer moving parts that might fail or break, by which head-support member 16 pivots and laterally shifts to assist with converting between a bed configuration and a seat configuration. Moreover, link assembly 171 attaches to a furniture-item base (e.g., frame 168), instead of to an armrest (or other portion of the shell), which allows the internal framework (e.g., frames 160, 168, 16, 14, and 12) to be more easily coupled to a shell using brackets 164. In addition, cam block 182 and cam-follower block 186 provide an advantageous mechanism (e.g., fewer moving parts that might fail or break) to initiate an upward movement of a junction between head-support member 16 and back-support member 14. Furthermore, locking block 198 provides an advantageous mechanism to secure furniture item 10 in a retracted position.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

Having thus described the invention, what is claimed is:

1. A furniture item having user-support frames that are convertible between a seat configuration and a bed configuration and that include a first support frame anchored to a furniture-item base and a middle support frame pivotably coupled to the first support frame, the furniture item comprising:

a link assembly that couples the first support frame to the furniture-item base and that includes two links positioned substantially parallel to one another;

a pin that couples the link assembly to the furniture-item base, wherein the two links are spaced apart by a roller, which provides rolling support against the furniture-item based when the link assembly pivots on the first pin;

a pivot mechanism that couples the link assembly to the first support frame, wherein the combination of the link assembly, the first pin, and the pivot mechanism facilitates both pivoting and lateral shifting of the first support frame relative to the furniture-item base;

a cam-follower block disposed under the first support frame and the middle support frame when the first support frame and the middle support frame are in the bed configuration, which is generally horizontal; and a cam block coupled to the middle support member proximate to a junction at which the middle support frame is pivotably coupled to the first support frame, wherein the cam block is aligned with the cam-follower block when the first support frame and the middle support frame are in the bed configuration, and wherein the cam block includes a arcuate surface that, when the first support frame laterally shifts, contacts the cam-follower block, thereby moving the junction upwardly.

2. The furniture item of claim 1, wherein the pivot mechanism includes a shaft that couples the two links to an attachment bracket of the first support frame.

3. The furniture item of claim 1, wherein the pin is removable to facilitate disconnection of the first support frame from the furniture-item base.

4. The furniture item of claim 1, wherein the cam-follower block is positioned on the furniture-item base.

5. A furniture item having user-support frames that are convertible between a seat configuration and a bed configuration, the furniture item comprising:

a furniture-item base;

a first support frame anchored to the furniture-item base by two links, which are positioned substantially parallel to one another;

a removable pin that couples the two links to one another and that pivotably couples the two links to the furniture-item base, wherein the two links are spaced apart by a roller, which provides rolling support against the furniture-item base when the two links pivot on the pin;

a pivot mechanism that couples the link assembly to an attachment bracket of the first support frame, wherein the combination of the link assembly, the first pin, and the pivot mechanism facilitates both pivoting and lateral shifting of the first support frame relative to the furniture-item base;

a middle support frame pivotably coupled to the first support frame;

a cam-follower block disposed under the first support frame and the middle support frame when the first support frame and the middle support frame are in the bed configuration, which is generally horizontal; and a cam block coupled to the middle support member proximate to a junction at which the middle support frame is pivotably coupled to the first support frame, wherein the cam block is aligned with the cam-follower block when the first support frame and the middle support frame are in the bed configuration, and wherein the cam block includes a surface that, when the first support frame laterally shifts, contacts the cam-follower block, thereby moving the junction upwardly.

6. The furniture item of claim 5, wherein the pivot mechanism includes a shaft that couples the two links to the attachment bracket of the first support frame.

7. A furniture item having user-support frames that are convertible between a seat configuration and a bed configuration and that include a first support frame anchored to a furniture-item base and a middle support frame pivotably coupled to the first support frame, the furniture item comprising:

a link assembly that couples the first support frame to the furniture-item base and that includes two links positioned substantially parallel to one another;

a pin that couples the link assembly to the furniture-item base, wherein the two links are spaced apart by a roller, which provides rolling support against the furniture-item base when the two links pivot on the pin;

a pivot mechanism that couples the link assembly to the first support frame;

a cam-follower block disposed under the first support frame and the middle support frame when the first support frame and the middle support frame are in the bed configuration; and a cam block coupled to the middle support member proximate to a junction at which the middle support frame is pivotably coupled to the first support frame, wherein the cam block includes a surface that, when the first support frame laterally shifts, contacts the cam-follower block, thereby moving the junction upwardly.

8. The furniture item of claim 7, wherein the combination of the link assembly, the first pin, and the pivot mechanism facilitates both pivoting and lateral shifting of the first support frame relative to the furniture-item base.

9. The furniture item of claim 7, wherein the cam block is aligned with the cam-follower block when the first support frame and the middle support frame are in the bed configuration.

10. The furniture item of claim 7, wherein the pivot mechanism includes a shaft that couples the two links to an attachment bracket of the first support frame.

11. The furniture item of claim 7, wherein the pin is removable to facilitate disconnection of the first support frame from the furniture-item base.

12. The furniture item of claim 7, wherein the cam-follower block is positioned on the furniture-item base.

* * * * *